US012145641B2

(12) United States Patent
Zhao

(10) Patent No.: US 12,145,641 B2
(45) Date of Patent: Nov. 19, 2024

(54) TRAIN DISPATCHING CONTROL METHOD, PLATFORM, AND SYSTEM, INTELLIGENT CARRIAGE, AND MEDIUM

(71) Applicant: BYD COMPANY LIMITED, Shenzhen (CN)

(72) Inventor: Jianchun Zhao, Shenzhen (CN)

(73) Assignee: BYD COMPANY LIMITED, Shenzhen (CN)

( * ) Notice: Subject to any disclaimer, the term of this patent is extended or adjusted under 35 U.S.C. 154(b) by 286 days.

(21) Appl. No.: 17/638,969

(22) PCT Filed: Jul. 31, 2020

(86) PCT No.: PCT/CN2020/106172
§ 371 (c)(1),
(2) Date: Feb. 28, 2022

(87) PCT Pub. No.: WO2021/036680
PCT Pub. Date: Mar. 4, 2021

(65) Prior Publication Data

US 2022/0297732 A1 Sep. 22, 2022

(30) Foreign Application Priority Data

Aug. 30, 2019 (CN) ..... 201910814673.3

(51) Int. Cl.
*B61L 27/04* (2006.01)
*B61B 1/00* (2006.01)
(Continued)

(52) U.S. Cl.
CPC ..... *B61L 27/04* (2013.01); *B61B 1/00* (2013.01); *B61L 27/10* (2022.01); *B61L 27/70* (2022.01)

(58) Field of Classification Search
CPC ..... B61L 27/04; B61L 27/70; B61L 27/10; B61B 1/00
See application file for complete search history.

(56) References Cited

U.S. PATENT DOCUMENTS 10,974,746 B2 * 4/2021 Mayo ..... B61L 27/20
2007/0299570 A1 * 12/2007 Muinonen ..... B61L 17/02 701/19

FOREIGN PATENT DOCUMENTS

CN 103124665 A 5/2013
CN 106276294 A 1/2017
(Continued)

OTHER PUBLICATIONS

The World Intellectual Property Organization (WIPO) International Search Report for PCT/CN2020/106172 Oct. 28, 2020 4 pages (with translation).

*Primary Examiner* — Anshul Sood
*Assistant Examiner* — Matthew Ho
(74) *Attorney, Agent, or Firm* — Wenye Tan

(57) ABSTRACT

A train dispatching control method includes obtaining a train marshalling instruction, determining target carriages corresponding to a marshalling quantity based on carriage positioning information corresponding to to-be-dispatched carriages parked on to-be-dispatched parking lines, and controlling all the target carriages to drive from the to-be-dispatched parking lines to a marshalling dispatch parking line, to form a target train. The train marshalling instruction includes the marshalling quantity.

7 Claims, 4 Drawing Sheets

(51) Int. Cl.
*B61L 27/10* (2022.01)
*B61L 27/70* (2022.01)

(56) References Cited

FOREIGN PATENT DOCUMENTS

| | | | | | |
|---|---|---|---|---|---|
| CN | 107878468 | A | | 4/2018 | |
| CN | 108045379 | A | | 5/2018 | |
| CN | 108482427 | A | | 9/2018 | |
| CN | 109808719 | A | | 5/2019 | |
| CN | 110027592 | A | | 7/2019 | |
| JP | 07294622 | A | | 11/1995 | |
| WO | WO-2014014624 | A1 | * | 1/2014 | ..... B61C 17/12 |

* cited by examiner

TRAIN DISPATCHING CONTROL METHOD, PLATFORM, AND SYSTEM, INTELLIGENT CARRIAGE, AND MEDIUM

CROSS-REFERENCE TO RELATED APPLICATIONS

This application is a national stage entry under 35 U.S.C. § 371 of International Application No. PCT/CN2020/106172, filed on Jul. 31, 2020, which claims priority to Chinese Patent Application No. 201910814673.3, filed on Aug. 30, 2019 and entitled "TRAIN DISPATCHING CONTROL METHOD, PLATFORM, AND SYSTEM, INTELLIGENT CARRIAGE, AND MEDIUM", the entire contents of all of which are incorporated herein by reference.

FIELD

The present disclosure relates to the field of rail transit technologies, and in particular, to a train dispatching control method, platform, and system, an intelligent carriage, and a medium.

BACKGROUND

Because the current urban rail transit has the characteristic that the number of passengers vary greatly in different time periods, a signal system is required to support train marshalling reconnection and unmarshalling in specific regions such as main lines and depots, so that reconnected and unmarshalled trains can maintain integrity functions such as train positioning and normal communication for safe and effective driving.

In the current urban rail transit system, trains with fixed marshalling are generally adopted, making it impossible to flexibly dispatch carriage quantities of trains to meet the different transportation capacities required in different time periods, resulting in low operating efficiency of trains.

SUMMARY

The present disclosure aims to resolve at least one of the technical problems existing in the related art.

Therefore, a first objective of the present disclosure is to provide a first train dispatching control method.

A second objective of the present disclosure is to provide a second train dispatching control method.

A third objective of the present disclosure is to provide a system control platform.

A fourth objective of the present disclosure is to provide a train dispatching control system.

To implement the foregoing objectives, according to a first aspect of embodiments of the present disclosure, a train dispatching control method is provided, and the method includes: obtaining a train marshalling instruction, the train marshalling instruction including a marshalling quantity; determining target carriages corresponding to the marshalling quantity based on carriage positioning information corresponding to to-be-dispatched carriages parked on to-be-dispatched parking lines; and controlling all the target carriages to drive from the to-be-dispatched parking lines to a marshalling dispatch parking line, to form a target train.

According to a second aspect of the embodiments of the present disclosure, a train dispatching control method is provided, and the method includes: obtaining an unmarshalling and storage instruction, the unmarshalling and storage instruction including a train identifier; determining a target train based on the train identifier, the target train including target carriages; and controlling, based on carriage types of the target carriages, the target carriages to drive from a marshalling dispatch parking line to to-be-dispatched parking lines corresponding to the carriage types.

According to a third aspect of the embodiments of the present disclosure, a system control platform is provided, and the control platform includes: a memory, a processor, and a computer program stored in the memory and capable of being run on the processor, where the processor implements the foregoing train dispatching control method when executing the computer program.

According to a fourth aspect of the embodiments of the present disclosure, a train dispatching control system is provided, and the control system includes the foregoing system control platform and at least one intelligent carriage connected to the system control platform, the system control platform communicating with a carriage control platform assembled on each intelligent carriage through a network.

According to the foregoing train dispatching control method, platform and system, the target carriages for the current train marshalling and reconnection can be quickly determined according to the marshalling quantity in the train marshalling instruction and the corresponding carriage positioning information corresponding to all to-be-dispatched carriages, thereby improving the efficiency of determining the target carriages. All the target carriages are then controlled to drive from the to-be-dispatched parking lines to the marshalling dispatch parking line, and every two adjacent target carriages are connected to quickly form the target train after marshalling. The target train formed by the target carriages corresponding to the marshalling quantity can be quickly obtained, thereby implementing the flexible deployment of the target train, so that the target train can meet transportation capacity requirements of corresponding time periods.

According to the foregoing train dispatching control method, platform and system, based on a comparison result of a train length and a region length and according to an unmarshalling dispatch sequence and a driving control instruction corresponding to the comparison result, the target carriages can be quickly controlled to drive to the to-be-dispatched parking lines respectively corresponding to the carriage types, to implement the rapid unmarshalling of the train, thereby improving the efficiency of train marshalling control, and improving the efficiency of subsequent automatic marshalling of the train.

According to the foregoing train dispatching control method, platform and system, the target carriages can automatically drive between the to-be-dispatched parking lines and the marshalling dispatch parking line according to the driving control instruction formed during the train marshalling or train unmarshalling, without manual driving of drivers, which helps to improve the driving efficiency and reduce labor costs, thereby improving the efficiency of train marshalling and train unmarshalling. Obstacle avoidance driving control is performed through obstacle detection information and carriage positioning information acquired in real time, to ensure that the target carriages can drive smoothly to a driving destination, so that the train marshalling or train unmarshalling process is automated, improving the dispatching efficiency during the train marshalling or train unmarshalling.

Other features and advantages of the present disclosure will be described in detail in the following specific implementations.

BRIEF DESCRIPTION OF THE DRAWINGS

The foregoing and/or additional aspects and advantages of the present disclosure will become apparent and comprehensible in the description of embodiments made with reference to the following accompanying drawings.

DETAILED DESCRIPTION

The following clearly and completely describes the technical solutions in the embodiments of the present disclosure with reference to the accompanying drawings in the embodiments of the present disclosure. Apparently, the described embodiments are some of the embodiments of the present disclosure rather than all of the embodiments. All other embodiments obtained by a person of ordinary skill in the art based on the embodiments of the present disclosure without creative efforts shall fall within the protection scope of the present disclosure.

An embodiment of the present disclosure provides a train dispatching control method. The train dispatching control method is specifically applied to a train dispatching control system shown in FIG. 1. The train dispatching control system includes a system control platform and at least one intelligent carriage connected to the system control platform, where the system control platform may communicate with a carriage control platform assembled on each intelligent carriage through a network. The system control platform may be further connected to a cloud platform, and the cloud platform may be configured to provide high-precision maps, model training, simulation calculations, data storage, algorithm update, background monitoring, or the like for the system control platform and the carriage control platform. The intelligent carriage may be a carriage capable of driving automatically.

Figure 1:
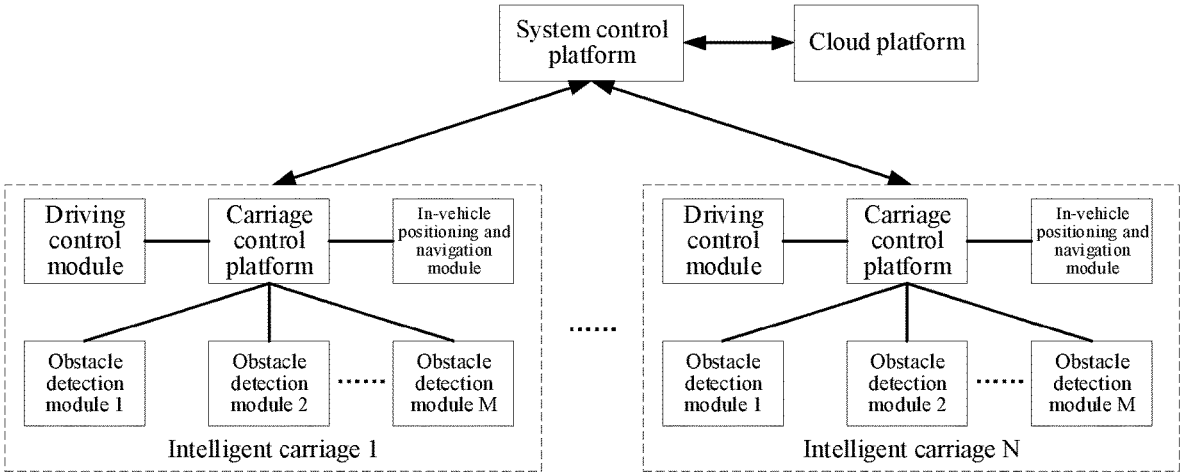
FIG. 1 is a schematic diagram of a train dispatching control system according to an embodiment of the present disclosure.

In an embodiment of the present disclosure, the train dispatching control method is applied to the system control platform shown in FIG. 1. The system control platform is communicatively connected to all to-be-dispatched carriages parked on to-be-dispatched parking lines, and can perform marshalling dispatch according to carriage positioning information of all the to-be-dispatched carriages, to flexibly dispatch trains to meet different transportation capacity requirements at different time periods. In this case, at least one intelligent carriage is a to-be-dispatched carriage. The system control platform may be implemented by an independent server or a server cluster formed by a plurality of servers. It may be understood that, each system control platform may be further communicatively connected to a client. The client is a program corresponding to the system control platform and configured to provide users with local services, and may be installed on a computer or other computer devices.

Each system control platform may be set up on a station. Several parking lines for cooperating to implement train marshalling reconnection and unmarshalling are set on the station, which specifically include a parking line for parking head carriages, a parking line for parking tail carriages, a parking line for parking middle carriages, and a parking line for marshalling dispatch. Since the head carriages, the tail carriages, and the middle carriages are all carriages that are reconnected or unmarshalled during the train dispatching control process. For ease of description, the head carriages, the tail carriages, and the middle carriages are collectively referred to as to-be-dispatched carriages, and the parking lines used for parking the to-be-dispatched carriages are collectively referred to as to-be-dispatched parking lines. Correspondingly, the parking line for marshalling dispatch is referred to as a marshalling dispatch parking line.

A head carriage and a tail carriage are two carriages with the same structure but opposite orientations, which are configured to form head carriage and tail carriage of a train after marshalling. During reciprocating operation of the train, the head carriage and the tail carriage may be interchanged. For example, when the train is running in a forward direction, the head carriage is the head of the train and the tail carriage is the tail of the train; and when the train runs in a rear direction, the head carriage is the tail of the train and the tail carriage is the head of the train. Since the head carriages and the tail carriages are paired carriages, during the train marshalling reconnection and unmarshalling, the head carriages and the tail carriages may be parked in pairs on the same parking line, to facilitate subsequent flexible dispatching of the head carriages and the tail carriages, improving the dispatching efficiency. Moreover, the head carriages and the tail carriages are parked on the same parking line, so that there is no need to separately construct a parking line for parking the head carriages and a parking line for parking the tail carriages, which helps to reduce the construction costs of the station.

To facilitate the distinction between different parking lines, the parking line for parking the head carriages and the tail carriages is defined as a first parking line, and the parking line for parking the middle carriages is defined as a second parking line. Therefore, the foregoing to-be-dispatched parking lines include the first parking line and the second parking line. Further, to facilitate train marshalling, the head carriages and the tail carriages may be parked on the first parking line in a staggered manner, to facilitate the marshalling reconnection or unmarshalling of the head carriages and the tail carriages in pairs during train marshalling.

It may be understood that, to ensure that the marshalling dispatch parking line can cooperate with the system control platform to realize the function of train dispatching control, the to-be-dispatched parking lines need to intersect the marshalling dispatch parking line, so that the to-be-dispatched carriages on the to-be-dispatched parking lines can flow onto the marshalling dispatch parking line, or the to-be-dispatched carriages on the marshalling dispatch parking line can flow onto the to-be-dispatched parking lines. In this embodiment, an intersection between the marshalling dispatch parking line and the to-be-dispatched parking lines is defined as a parking line intersection.

Since the marshalling dispatch parking line has the parking line intersection that intersects the to-be-dispatched parking lines, it may be understood that the marshalling dispatch parking line may be divided into two parking regions based on the parking line intersection, which are defined as a first parking region and a second parking region. The first parking region is a parking region not set corresponding to the to-be-dispatched parking lines, and the second parking region is a parking region set corresponding to the to-be-dispatched parking lines. Since the first parking region is not set corresponding to the to-be-dispatched parking lines, when running between the first parking region and the to-be-dispatched parking lines, the to-be-dispatched carriages may run in a same direction without reversing. However, the second parking region is set corresponding to the to-be-dispatched parking lines, so that when running between the second parking region and the to-be-dispatched parking lines, the to-be-dispatched carriages need to first run in one direction and then run in the other direction.

Figure 9:
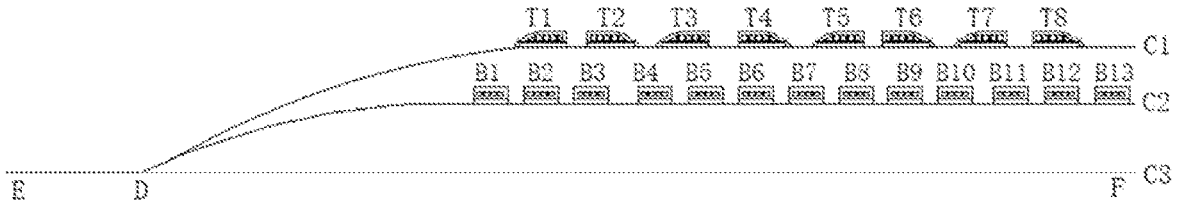
FIG. 9 is a schematic diagram of a first scenario of a train dispatching control method according to an embodiment of the present disclosure.

FIG. 9 is a schematic diagram of a parking line distribution of a station. As shown in FIG. 9, C1 is a first parking line for parking head carriages and tail carriages (T1/T2 . . . T8), and C2 is a second parking line for parking middle carriages (B1/B2 . . . B13). The to-be-dispatched parking lines include the first parking line C1 and the second parking line C2. C3 is a marshalling dispatch parking line, and a point D where the marshalling dispatch parking line C3 intersects the first parking line C1 and the second parking line C2 is a parking line intersection. A region where two points of D and F are located is set corresponding to the first parking line C1 and the second parking line C2. Therefore, a region on the marshalling dispatch parking line C3 between the two points of D and F is the second parking region. A region where two points of D and E are located is not set corresponding to the first parking line C1 and the second parking line C2. Therefore, a region on the marshalling dispatch parking line C3 between the two points of D and E is the first parking region.

Figure 2:
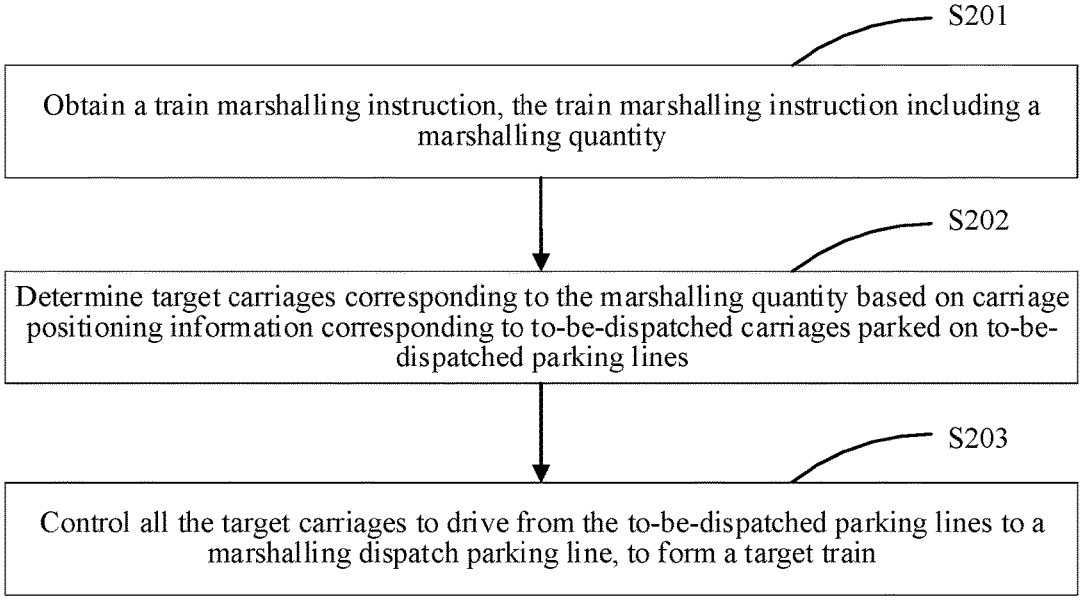
FIG. 2 is a flowchart of a train dispatching control method according to a first embodiment of the present disclosure.

In an embodiment of the present disclosure, a train dispatching control method is provided. The train dispatching control method may be applied to the system control platform in FIG. 1, so that the system control platform implements unified marshalling dispatch of all to-be-dispatched carriages, improving the marshalling dispatch efficiency. As shown in FIG. 2, the train dispatching control method includes the following steps:

S201: Obtain a train marshalling instruction, the train marshalling instruction including a marshalling quantity.

The train marshalling instruction is an instruction used for triggering the system control platform to control the train marshalling and reconnection. The marshalling quantity is used for limiting a quantity of carriages required for the current marshalling, and the marshalling quantity may be set according to the transportation capacity requirements at the current time period. In the process of train marshalling, each train after marshalling needs to include a head carriage, a tail carriage, and at least one middle carriage. Therefore, a marshalling quantity N is at least three. It may be understood that, a user may independently configure the marshalling quantity corresponding to the current marshalled train according to the transportation capacity requirements at the current time period, to realize the flexible configuration of the train.

S202: Determine target carriages corresponding to the marshalling quantity based on carriage positioning information corresponding to to-be-dispatched carriages parked on to-be-dispatched parking lines.

The carriage positioning information corresponding to the to-be-dispatched carriages is information used for reflecting current positions of the to-be-dispatched carriages, and may be specifically the carriage positioning information sent to the system control platform in real time by the to-be-dispatched carriages. The target carriages refer to carriages that are selected for carriage reconnection to construct a marshalled train. To ensure function implementation of the marshalled train, head carriages, tail carriages, and middle carriages that match the marshalling quantity need to be selected as the target carriages. It may be understood that, the to-be-dispatched carriages of each carriage type on the to-be-dispatched parking lines may be independently controlled to complete functions such as carriage obstacle checking, positioning, and driving, which helps reduce costs.

The head carriages, the tail carriages, and the middle carriages are collectively referred to as the to-be-dispatched carriages, the parking lines for parking the to-be-dispatched carriages are collectively referred to as the to-be-dispatched parking lines, and the to-be-dispatched parking lines include the parking line for parking the head carriages, the parking line for parking the tail carriages, and the parking line for parking the middle carriages. Therefore, it may be determined that the system control platform can obtain the carriage positioning information of all the to-be-dispatched carriages currently parked on the to-be-dispatched parking lines, to quickly determine the target carriages corresponding to the marshalling quantity according to the marshalling quantity required for the current marshalling.

In an implementation of the present disclosure, if the marshalling quantity is N, and the head carriages, the tail carriages, and the middle carriages are parked on respective parking lines, after obtaining carriage positioning information of all the head carriages, the tail carriages, and the middle carriages, the system control platform sequentially determines corresponding target carriages from outermost sides of respective parking lines, that is, determines one head carriage parked on an outermost side of the first parking line as a target carriage, determines a tail carriage parked on an outermost side of the first parking line as a target carriage, and determines N−2 middle carriages parked on an outermost side of the second parking line as target carriages, to quickly determine the target carriages corresponding to the marshalling quantity. An outermost side of a parking line is a side that is connected to a parking line intersection of the marshalling dispatch parking line. The outermost to-be-dispatched carriages on the parking lines are sequentially determined as the target carriages, to facilitate the dispatching of the target carriages.

In an implementation of the present disclosure, the to-be-dispatched carriages include head carriages, tail carriages, and middle carriages; and the to-be-dispatched parking lines include a first parking line for parking the head carriages and the tail carriages, and a second parking line for parking the middle carriages. The head carriages and the tail carriages are parked together on the first parking line, and are specifically parked on the first parking line in a staggered manner, which helps to reduce the construction costs of the parking lines, facilitates the unified dispatching of the head carriages and the tail carriages, and improves the dispatching efficiency.

That is, step S202 specifically includes: determining an outermost group of head carriage and tail carriage on the first parking line as target carriages, and determining N−2 outermost middle carriages on the second parking line as target carriages, N being the marshalling quantity. It may be understood that, since the head carriages and the tail carriages are parked on the first parking line in a staggered manner, so that during determination of the target carriages, the outermost group of head carriage and tail carriage on the first parking line is determined as the target carriages, improving the efficiency of determining the target carriages, and facilitating the dispatching of the target carriages.

For example, in FIG. 9, the marshalling quantity N in the current train marshalling instruction equals 6. Therefore, one head carriage, one tail carriage, and four middle carriages need to be determined as the target carriages in this case. An outermost group of head carriage T1 and tail carriage T2 on the first parking line C1 may be selected as target carriages, and four outermost middle carriages B1/B2/B3/B4 on the second parking line C2 may be selected as target carriages, to realize rapid dispatching of the target carriages.

S203: Control all the target carriages to drive from the to-be-dispatched parking lines to a marshalling dispatch parking line, to form a target train.

Specifically, after determining the corresponding target carriages according to the carriage positioning information of the to-be-dispatched carriages, the system control platform needs to sequentially control each target carriage to drive from the to-be-dispatched parking lines to the marshalling dispatch parking line, so that two adjacent target carriages can be connected to form a target train of "head carriage-middle carriage-tail carriage". The target train is a train after marshalling. Before two adjacent target carriages are connected, a connecting piece of one target carriage and a to-be-connected piece of an adjacent target carriage may be moved closer for sorting. For example, a connecting piece of a head carriage and a to-be-connected piece of an adjacent middle carriage are moved closer for sorting, so that the head carriage may be connected to the middle carriage. It may be understood that, after each target train undergoes train marshalling, in order to facilitate the identification and monitoring of operation of the target train, the target train may be configured with a corresponding train identifier, to distinguish different target trains.

In this embodiment, the system control platform sends a corresponding control instruction to the target carriages, so that drivers on the target carriages can control the target carriages to drive from the to-be-dispatched parking lines to the marshalling dispatch parking line according to the control instruction, to complete the marshalling of the target train. Alternatively, the system control platform sends a corresponding control instruction to the target carriages, so that the target carriages automatically drive from the to-be-dispatched parking lines to the marshalling dispatch parking line according to the control instruction, so that the marshalling and reconnection operation of the target carriages are automatically completed, which not only reduces the costs of marshalling, but also helps to improve the efficiency of marshalling.

In the train dispatching control method provided in this embodiment, the target carriages for the current train marshalling and reconnection can be quickly determined according to the marshalling quantity in the train marshalling instruction and the corresponding carriage positioning information corresponding to all to-be-dispatched carriages, thereby improving the efficiency of determining the target carriages. All the target carriages are then controlled to drive from the to-be-dispatched parking lines to the marshalling dispatch parking line, and every two adjacent target carriages are connected to quickly form the target train after marshalling. The target train formed by the target carriages corresponding to the marshalling quantity can be quickly obtained, thereby implementing the flexible deployment of the target train, so that the target train can meet transportation capacity requirements of corresponding time periods.

Figure 3:
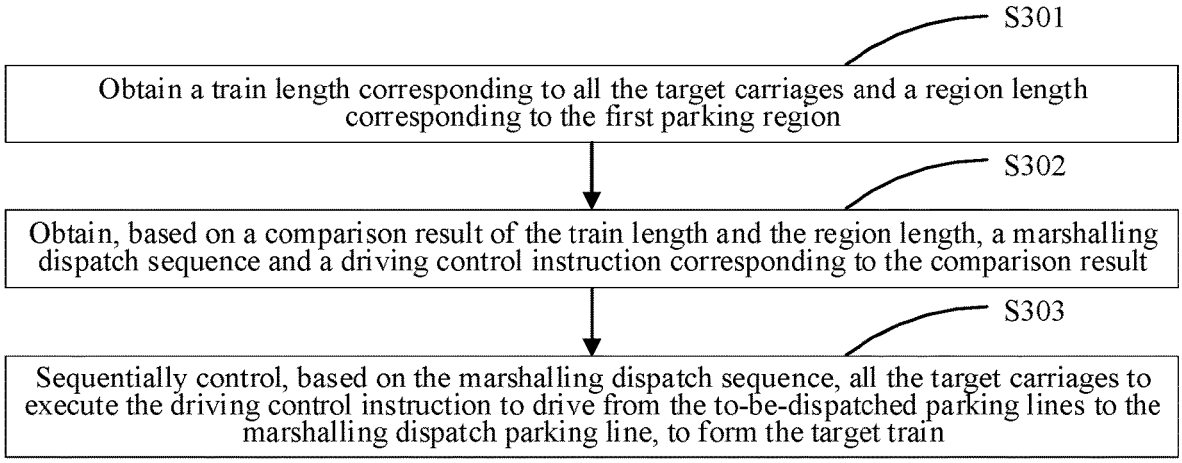
FIG. 3 is a flowchart of a train dispatching control method according to a second embodiment of the present disclosure.

In an embodiment of the present disclosure, the marshalling dispatch parking line and the to-be-dispatched parking lines intersect at a parking line intersection, and the marshalling dispatch parking line includes a first parking region and a second parking region formed based on the parking line intersection. The first parking region is a parking region not set corresponding to the to-be-dispatched parking lines, and the second parking region is a parking region set corresponding to the to-be-dispatched parking lines. Since the first parking region is not set corresponding to the to-be-dispatched parking lines, when running between the first parking region and the to-be-dispatched parking lines, the to-be-dispatched carriages may run in a same direction without reversing. However, the second parking region is set corresponding to the to-be-dispatched parking lines, so that when running between the second parking region and the to-be-dispatched parking lines, the to-be-dispatched carriages need to first run in one direction, and then reverse to run in the other direction. Correspondingly, as shown in FIG. 3, S203, that is, controlling all the target carriages to drive from the to-be-dispatched parking lines to a marshalling dispatch parking line, to form a target train further includes the following steps:

S301: Obtain a train length corresponding to all the target carriages and a region length corresponding to the first parking region.

Figure 10:
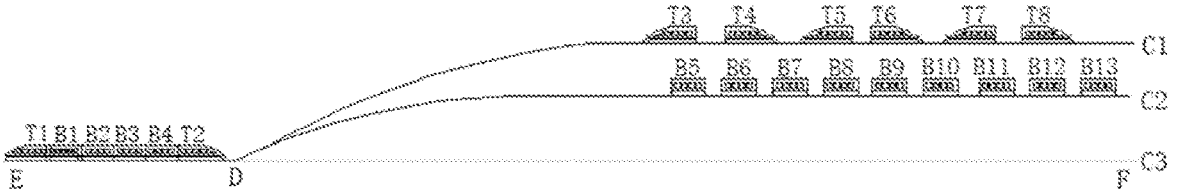
FIG. 10 is a schematic diagram of a second scenario of a train dispatching control method according to an embodiment of the present disclosure.
Figure 11:
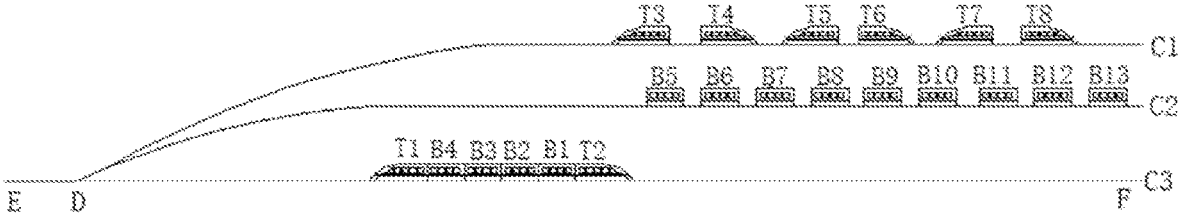
FIG. 11 is a schematic diagram of a third scenario of a train dispatching control method according to an embodiment of the present disclosure.

The train length corresponding to all the target carriages refers to a length corresponding to the target train to be formed by all the target carriages, and is specifically a sum of lengths corresponding to all the target carriages. As shown in FIG. 10 to FIG. 11, since the marshalling quantity N equals 6, the train length is a sum of lengths of six target carriages of the head carriage T1, the tail carriage T2, and the middle carriages B1/B2/B3/B4. A region length corresponding to the first parking region is a length corresponding to the DE section in the marshalling dispatch parking line C1. The region length corresponding to the first parking region is a constant, which is determined when the parking lines of the station are constructed.

S302: Obtain, based on a comparison result of the train length and the region length, a marshalling dispatch sequence and a driving control instruction corresponding to the comparison result.

The marshalling dispatch sequence refers to a sequence in which the plurality of target carriages corresponding to marshalling quantity are sequentially dispatched onto the marshalling dispatch parking line. The driving control instruction is a control instruction used for controlling the operation of each target carriage in the marshalling dispatch process. The driving control instruction includes a target driving route. In the train marshalling process, the target driving route is a driving route from the to-be-dispatched parking lines to the marshalling dispatch parking line.

Since the train length corresponding to all the target carriages is determined by the marshalling quantity in the train marshalling instruction, and the region length of the first parking region is determined when the parking lines of the station are constructed, the region length may be greater than the train length, or may not be greater than the train length. When driving from the to-be-dispatched parking lines to the first parking region of the marshalling dispatch parking line, that is, when driving from the first parking line C1 or the second parking line C2 onto the DE section of the marshalling dispatch parking line C2, the target carriages may run in a same direction without reversing. When driving from the to-be-dispatched parking lines to the second parking region of the marshalling dispatch parking line, that is, when driving from the first parking line C1 or the second parking line C2 onto the DF section of the marshalling dispatch parking line C2, the target carriages need to first run in one direction until the tail of the target carriages passes a parking line intersection D, and then run in another direction. Therefore, the comparison result of the train length and the region length affects the marshalling dispatch sequence and the driving control instruction for dispatching of all the target carriages.

For example, if the region length of the first parking region is greater than the train length, the train marshalling may be carried out on the first parking region. In this case, the target carriages only need to run straight to the first parking region during driving, and the head carriage, the middle carriages, and the tail carriage may be sequentially dispatched, to complete the reconnection process of the train marshalling on the first parking line. When the region length of the first parking region is not greater than the train length, if the head carriage, the middle carriages, and the tail carriage are directly dispatched sequentially, the target carriages behind may not drive to the marshalling dispatch parking line. Therefore, the reconnection process of the train marshalling needs to be carried out in the second parking region. When the region length of the first parking region is greater than or not greater than the train length, it may be determined whether the marshalling and reconnection process may be carried out on the first parking region, and different target carriages have a different dispatch sequence during the marshalling and reconnection process. Therefore, a corresponding marshalling dispatch sequence needs to be configured, and a corresponding driving control instruction is sequentially sent to each target carriage according to the marshalling dispatch sequence, so that the target carriages are controlled to drive to the marshalling dispatch parking line according to the received driving control instruction.

S303: Sequentially control, based on the marshalling dispatch sequence, all the target carriages to execute the driving control instruction to drive from the to-be-dispatched parking lines to the marshalling dispatch parking line, to form the target train.

The comparison result of the train length and the region length may be that the region length is greater than the train length, or the region length is not greater than the train length. Each comparison result may correspond to a different marshalling dispatch sequence and a different driving control instruction. Therefore, after obtaining a marshalling dispatch sequence and a driving control instruction, the system control platform first determines, according to the marshalling dispatch sequence, a target carriage that needs to be dispatched currently, and then sends the corresponding driving control instruction to the target carriage that needs to be dispatched currently, to control the target carriage that needs to be dispatched currently to drive from a to-be-dispatched parking line to a marshalling dispatch parking line, and so on, until all target carriages drive to the marshalling dispatch parking line. Further, every two adjacent target carriages are connected to form a target train, thereby completing the rapid train marshalling process.

In the train dispatching control method provided in this embodiment, based on the comparison result of the train length and the region length and according to the unmarshalling dispatch sequence and the driving control instruction corresponding to the comparison result, the target carriages are controlled to drive to the marshalling dispatch parking line for the marshalling and reconnection operation, implementing rapid train marshalling, and improving the efficiency of train marshalling.

In an example, as shown in FIG. 10, specific implementation steps corresponding to steps S301 to S303 are as follows:

S311: Obtain a train length corresponding to all the target carriages and a region length corresponding to the first parking region.

S312: Obtain a first dispatch sequence and a first driving instruction corresponding to each target carriage if the region length is greater than the train length.

S313: Sequentially control, based on the first dispatch sequence, all the target carriages to execute the first driving instruction to drive from the to-be-dispatched parking lines to the marshalling dispatch parking line, to form the target train.

Step S311 is the same as step S301. To avoid repetition, the details are not repeated herein. Step S312 is a specific implementation of step S302, and step S313 is a specific implementation of step S303.

The first dispatch sequence refers to a dispatch sequence among all the target carriages when the region length is greater than the train length, which is a type of marshalling dispatch sequence. The first driving instruction refers to a driving control instruction corresponding to each target carriage when the region length is greater than the train length. In this case, a target driving route in the first driving instruction is a driving route from the to-be-dispatched parking lines to the first parking region of the marshalling dispatch parking line. Since the region length is greater than the train length, and the reconnection process of the train marshalling may be performed on the first parking region, all the target carriages may run straight to the first parking region without reversing.

As shown in FIG. 10, the region length of the first parking region is greater than the length of the train formed by all the target carriages with the marshalling quantity of 6. In this case, the reconnection process of the train marshalling may be performed in the first parking region, and the first dispatch sequence formed is T1/B1/B2/B3/B4/T2, which is configured to control the target driving route in the first driving instruction of each target carriage to be from the to-be-dispatched parking lines to the first parking region of the marshalling dispatch parking line. According to the sequence of T1/B1/B2/B3/B4/T2, each target carriage may be sequentially dispatched to execute the first driving instruction, so that the target carriages drive from the to-be-dispatched parking lines to the first parking region of the marshalling dispatch parking line, and every two adjacent target carriages are connected, to quickly form the target train after marshalling. Since all the target carriages may drive to the first parking region, there is no need to reverse, so that all the target carriages with the relatively small marshalling quantity can be quickly marshalled into the target train, which helps to improve the marshalling efficiency of the target train.

In another example, as shown in FIG. 11, specific implementation steps corresponding to steps S301 to S303 are as follows:

S321: Obtain a train length corresponding to all the target carriages and a region length corresponding to the first parking region.

S322: Obtain a second dispatch sequence and a second driving instruction corresponding to each target carriage if the region length is not greater than the train length.

S323: Sequentially control, based on the second dispatch sequence, all the target carriages to execute the second driving instruction to drive from the to-be-dispatched parking lines to the marshalling dispatch parking line, to form the target train.

Step S321 is the same as step S301. To avoid repetition, the details are not repeated herein. Step S322 is a specific implementation of step S302, and step S323 is a specific implementation of step S303.

The second dispatch sequence refers to a dispatch sequence among all the target carriages when the region length is not greater than the train length, which is a type of marshalling dispatch sequence. The second driving instruction refers to a driving control instruction corresponding to each target carriage when the region length is not greater than the train length. In this case, a target driving route in the second driving instruction is a driving route from the to-be-dispatched parking lines to the second parking region of the marshalling dispatch parking line. Since the region length is not greater than the train length, the reconnection process of the train marshalling cannot be carried out only in the first parking region, but needs to be cooperatively carried out in the first parking region and the second parking region. In addition, in the process of driving from the to-be-dispatched parking lines to the second parking region, the target carriages need to run straight and reverse before driving to the second parking region.

As shown in FIG. 11, since the head carriage T1 and the tail carriage T2 need to be located at the head and tail ends of the formed target train, and the middle carriages B1/B2/B3/B4 are located between the head carriage T1 and the tail carriage T2, the second dispatch sequence formed in this solution is T1/T2/B1/B2/B3/B4/T1, that is, T1 is first controlled to drive from C1 to the first parking region (that is, the DE section) of C3, and T2 is controlled to first run straight from C1 and then reserve to the second parking region (that is, the DF section) of C3. B1/B2/B3/B4 are then sequentially controlled to run straight first and then reverse to the second parking region (the DF section) of C3. Finally, T1 is reserved from the first parking region to the second parking region, so that every two adjacent target carriages are connected to form the target train, to ensure that the target carriages with the relatively large marshalling quantity can be reconnected smoothly to form the target train.

Figure 4:
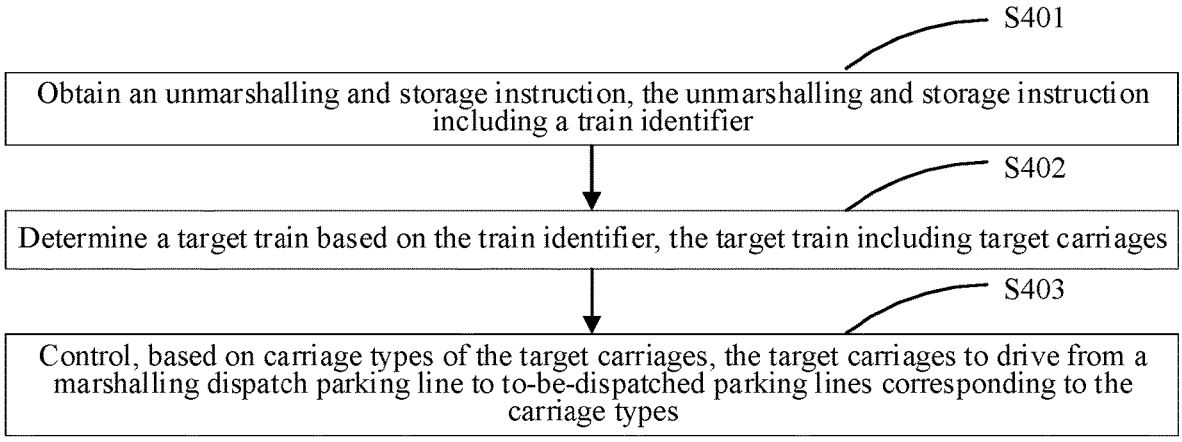
FIG. 4 is a flowchart of a train dispatching control method according to a third embodiment of the present disclosure.

In an embodiment of the present disclosure, a train dispatching control method is provided. The train dispatching control method may be applied to the system control platform in FIG. 1, so that the system control platform implements unmarshalling dispatch of the target train, improving the unmarshalling dispatch efficiency. As shown in FIG. 4, the train dispatching control method includes the following steps:

S401: Obtain an unmarshalling and storage instruction, the unmarshalling and storage instruction including a train identifier.

The unmarshalling and storage instruction is an instruction used for triggering the system control platform to control the train unmarshalling. The train identifier in the unmarshalling and storage instruction refers to an identifier corresponding to the train that needs to be unmarshalled currently. It may be understood that after the operation of a train ends, all carriages on the train need to be unmarshalled and parked on to-be-dispatched parking lines, to facilitate train marshalling next time.

S402: Determine a target train based on the train identifier, the target train including target carriages.

The target train in this embodiment refers to a train that needs to be unmarshalled currently. The target carriages refer to all the carriages connected to each other to form the target train, that is, all the intelligent carriages in FIG. 1. The target carriages have three carriage types: a head carriage, middle carriages, and a tail carriage. Moreover, the head carriage, the middle carriages, and the tail carriages can all reduce the costs of the train, and ensure that the head carriage and the tail carriage can be interchanged during the reciprocating operation.

S403: Control, based on carriage types of the target carriages, the target carriages to drive from a marshalling dispatch parking line to to-be-dispatched parking lines corresponding to the carriage types.

The marshalling dispatch parking line is a parking line configured to realize the marshalling dispatch function, and the train marshalling and reconnection and the train unmarshalling process can be implemented using the parking line. In an example, the to-be-dispatched parking lines may be a general term for a parking line for parking a head carriage, a parking line for parking a tail carriage, and a parking line for parking middle carriages.

Specifically, according to the carriage types of the target carriages, the system control platform may control the head carriage to drive from the marshalling dispatch parking line to the to-be-dispatched parking line corresponding to the head carriage, control the middle carriages to drive from the marshalling dispatch parking line to the to-be-dispatched parking line corresponding to the middle carriages, and control the tail carriage to drive from the marshalling dispatch parking line to the to-be-dispatched parking line corresponding to the tail carriage, to complete the unmarshalling operation of the target train, so that the head carriage, the middle carriages, and the tail carriage after marshalling may be marshalled into a train again, that is, performing steps S201 to S203 to form a new target train, to ensure the subsequent train dispatching control based on different transportation capacity requirements. It may be understood that, the driving process of the controlled target carriages may be manual driving, or may be automatic driving of the target carriages.

In an example, the to-be-dispatched parking lines include a first parking line for parking the head carriages and the tail carriages, and a second parking line for parking the middle carriages. The head carriages and the tail carriages are parked together on the first parking line, and are specifically parked on the first parking line in a staggered manner, which helps to reduce the construction costs of the parking lines, facilitates the unified dispatching of the head carriages and the tail carriages, and improves the dispatching efficiency. As shown in FIG. 9, the to-be-dispatched parking lines include a first parking line C1 and a second parking line C2. C1 is a first parking line for parking head carriages and tail carriages (T1/T2 . . . T8), and C2 is a second parking line for parking middle carriages (B1/B2 . . . B13).

In the train dispatching control method provided in this embodiment, according to the target train determined by the unmarshalling and storage instruction, all the target carriages in the target train drive to the to-be-dispatched parking lines corresponding to the carriage types, so that during subsequent train marshalling, the corresponding target carriages can be quickly determined from the to-be-dispatched parking lines corresponding to the carriage types, which helps to improve the flexibility and efficiency of train marshalling, and ensures the feasibility of train marshalling that meets different transportation capacity requirements.

Figure 5:
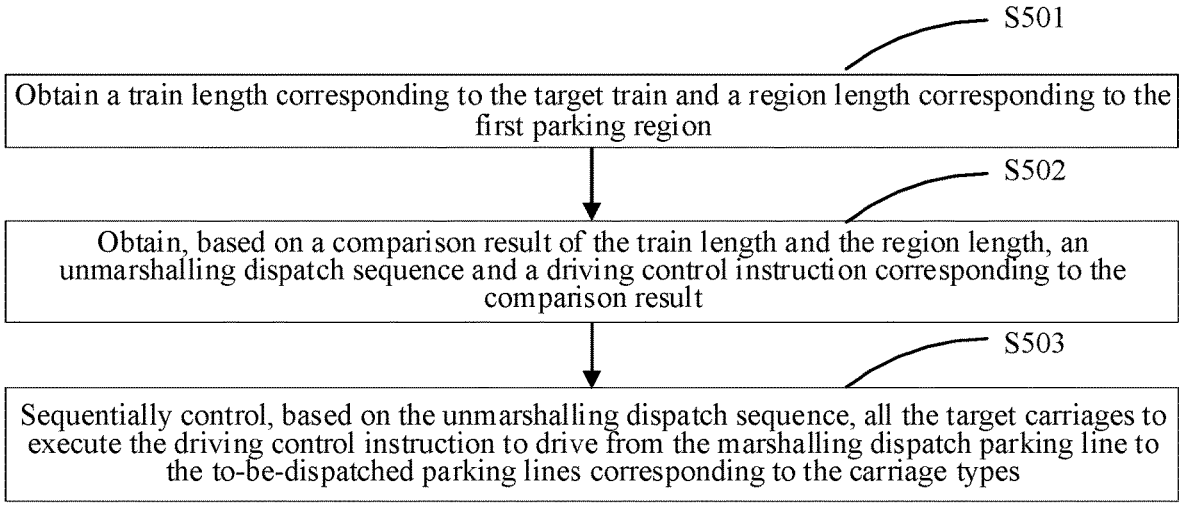
FIG. 5 is a flowchart of a train dispatching control method according to a fourth embodiment of the present disclosure.

In an embodiment of the present disclosure, the marshalling dispatch parking line and the to-be-dispatched parking lines intersect at a parking line intersection, and the marshalling dispatch parking line includes a first parking region and a second parking region formed based on the parking line intersection. The first parking region is a parking region not set corresponding to the to-be-dispatched parking lines, and the second parking region is a parking region set corresponding to the to-be-dispatched parking lines. As the parking line intersection D shown in FIG. 9, the first parking region is the DE section, and the second parking region is the DF section. Correspondingly, as shown in FIG. 5, S403, that is, controlling, based on carriage types of the target carriages, the target carriages to drive from a marshalling dispatch parking line to to-be-dispatched parking lines corresponding to the carriage types further includes the following steps:

S501: Obtain a train length corresponding to the target train and a region length corresponding to the first parking region.

The train length of the target train is a sum of lengths corresponding to all the target carriages. As shown in FIG. 10 to FIG. 11, since the marshalling quantity N equals 6, the train length is a sum of lengths of six target carriages of the head carriage T1, the tail carriage T2, and the middle carriages B1/B2/B3/B4. A region length corresponding to the first parking region is a length corresponding to a DE section in the marshalling dispatch parking line C1. The region length corresponding to the first parking region is a constant, which is determined when the parking lines of the station are constructed.

S502: Obtain, based on a comparison result of the train length and the region length, an unmarshalling dispatch sequence and a driving control instruction corresponding to the comparison result.

The unmarshalling dispatch sequence refers to a sequence in which each target carriage is sequentially dispatched to the to-be-dispatched parking lines when the target train is unmarshalled. The driving control instruction is a control instruction used for controlling the operation of each target carriage in the marshalling dispatch process. The driving control instruction includes a target driving route. In the train unmarshalling process, the target driving route is a driving route from the marshalling dispatch parking line to the to-be-dispatched parking lines.

Since the train length of the target train is a sum of lengths corresponding to all the target carriages, that is, determined by the marshalling quantity, and the region length of the first parking region is determined when the parking lines of the station are constructed, the region length may be greater than the train length, or may not be greater than the train length. When driving from the first parking region of the marshalling dispatch parking line to the to-be-dispatched parking lines, that is, when driving from the DE section of the marshalling dispatch parking line C2 into the first parking line C1 or the second parking line C2, the target carriages may run in a same direction without reversing. When driving from the second parking region of the marshalling dispatch parking line to the to-be-dispatched parking lines, that is, when driving from the DF section of the marshalling dispatch parking line C2 into the first parking line C1 or the second parking line C2, the target carriages need to first run in one direction until the tail of the target carriages passes a parking line intersection D, and then reverse to run in another direction. Therefore, the comparison result of the train length and the region length affects the unmarshalling dispatch sequence and the driving control instruction for dispatching of all the target carriages.

For example, if the region length of the first parking region is greater than the train length, the train unmarshalling process may be carried out on the first parking region. In this case, the target carriages only need to run straight from the first parking region to the to-be-dispatched parking lines during driving, and the head carriage, the middle carriages, and the tail carriage may be sequentially dispatched (or the tail carriage, the middle carriages, and the head carriage may be sequentially dispatched), to complete the train unmarshalling process. When the region length of the first parking region is not greater than the train length, since some target carriages on the target train cannot enter the first parking region together, the train can run straight and enter the corresponding to-be-dispatched parking lines during unmarshalling. Therefore, a train unmarshalling operation needs to be performed on the second parking region. When the region length of the first parking region is greater than or not greater than the train length, it may be determined whether the train unmarshalling process may be carried out on the first parking region, and different target carriages have a different dispatch sequence during the unmarshalling process. Therefore, a corresponding unmarshalling dispatch sequence needs to be configured, and a corresponding driving control instruction is sequentially sent to each target carriage according to the unmarshalling dispatch sequence, so that the target carriages are controlled to drive to the to-be-dispatched parking lines corresponding to the carriage types according to the received driving control instruction.

S503: Sequentially control, based on the unmarshalling dispatch sequence, all the target carriages to execute the driving control instruction to drive from the marshalling dispatch parking line to the to-be-dispatched parking lines corresponding to the carriage types.

The comparison result of the train length and the region length may be that the region length is greater than the train length, or the region length is not greater than the train length. Each comparison result may correspond to a different unmarshalling dispatch sequence and a different driving control instruction. Therefore, in an example, after obtaining the unmarshalling dispatch sequence and the driving control instruction, the system control platform disconnects every two adjacent target carriages in the target train, so that each target carriage is controlled independently; determines a target carriage that needs to be dispatched currently according to the unmarshalling dispatch sequence; and sends the corresponding driving control instruction to the target carriage that needs to be dispatched currently, to control the target carriage that needs to be dispatched currently to drive from the marshalling dispatch parking line to a to-be-dispatched parking line corresponding to a carriage type thereof, . . . , and so on, until all the target carriages drive to the to-be-dispatched parking lines corresponding to the carriage types, to complete the train unmarshalling process. In this way, all the target carriages are parked according to the carriage types during the train unmarshalling process, to facilitate the subsequent train marshalling, improving the efficiency of train marshalling.

In the train dispatching control method provided in this embodiment, based on a comparison result of a train length and a region length and according to an unmarshalling dispatch sequence and a driving control instruction corresponding to the comparison result, the target carriages can be quickly controlled to drive to the to-be-dispatched parking lines respectively corresponding to the carriage types, to implement the rapid unmarshalling of the train, thereby improving the efficiency of train unmarshalling control, and improving the efficiency of subsequent automatic marshalling of the train.

In a specific implementation, as shown in FIG. 10, specific implementation steps corresponding to steps S501 to S503 are as follows:

S311: Obtain a train length corresponding to the target train and a region length corresponding to the first parking region.

S312: Obtain a first unmarshalling sequence and a first driving instruction corresponding to each target carriage if the region length is greater than the train length.

S313: Sequentially control, based on the first unmarshalling sequence, all the target carriages to execute the first driving instruction to drive from the marshalling dispatch parking line to the to-be-dispatched parking lines corresponding to the carriage types.

Step S511 is the same as step S501. To avoid repetition, the details are not repeated herein. Step S512 is a specific implementation of step S502, and step S513 is a specific implementation of step S503.

The first unmarshalling sequence refers to a sequence of unmarshalling dispatch among all the target carriages when the region length is greater than the train length, which is a type of unmarshalling dispatch sequence. The first driving instruction refers to a driving control instruction corresponding to each target carriage when the region length is greater than the train length. Since the region length is greater than the train length, the train unmarshalling process may be carried out in the first parking region, and all the target carriages may enter the first parking region together, and then run straight to the to-be-dispatched parking lines corresponding to the carriage types without reversing. Therefore, the first driving instruction is specifically a straight driving instruction.

As shown in FIG. 10, the region length of the first parking region is greater than the length of the train formed by all the target carriages with the marshalling quantity of 6. In this case, the train unmarshalling process may be performed in the first parking region, and the first unmarshalling sequence formed is T2/B4/B3/B2/B1/T1, which is configured to control the first driving instruction for each target carriage. According to the sequence of T2/B4/B3/B2/B1/T1, each target carriage may be sequentially controlled to execute the first driving instruction, so that all the target carriages drive from the marshalling dispatch parking line to the to-be-dispatched parking lines corresponding to the carriage types, to complete the train unmarshalling process. In this way, all the target carriages are parked according to the carriage types during the train unmarshalling process, to facilitate the subsequent train marshalling, improving the efficiency of train marshalling.

In a specific implementation, as shown in FIG. 11, specific implementation steps corresponding to steps S501 to S503 are as follows:

S511: Obtain a train length corresponding to the target train and a region length corresponding to the first parking region.

S512: Obtain a first unmarshalling sequence and a first driving instruction corresponding to each target carriage if the region length is greater than the train length.

S513: Sequentially control, based on the first unmarshalling sequence, all the target carriages to execute the first driving instruction to drive from the marshalling dispatch parking line to the to-be-dispatched parking lines corresponding to the carriage types.

Step S511 is the same as step S501. To avoid repetition, the details are not repeated herein. Step S512 is a specific implementation of step S502, and step S513 is a specific implementation of step S503.

The first unmarshalling sequence refers to a sequence of unmarshalling dispatch among all the target carriages when the region length is greater than the train length, which is a type of unmarshalling dispatch sequence. The first driving instruction refers to a driving control instruction corresponding to each target carriage when the region length is greater than the train length. In this case, a target driving route in the first driving instruction is from the first parking region of the marshalling dispatch parking line to the to-be-dispatched parking lines. Since the region length is greater than the train length, the train unmarshalling process may be carried out in the first parking region, and all the target carriages may enter the first parking region together, and then respectively run straight to the to-be-dispatched parking lines corresponding to the carriage types without reversing.

As shown in FIG. 10, the region length of the first parking region is greater than the length of the train formed by all the target carriages with the marshalling quantity of 6. In this case, the train unmarshalling process may be performed in the first parking region, and the first unmarshalling sequence formed is T2/B4/B3/B2/B1/T1, which is configured to control the target driving route in the first driving instruction of each target carriage to be a driving route from the first parking region of the marshalling dispatch parking line to the to-be-dispatched parking lines. According to the sequence of T2/B4/B3/B2/B1/T1, each target carriage may be sequentially controlled to execute the first driving instruction, so that all the target carriages drive from the marshalling dispatch parking line to the to-be-dispatched parking lines corresponding to the carriage types, to complete the train unmarshalling process. In this way, all the target carriages are parked according to the carriage types during the train unmarshalling process, to facilitate the subsequent train marshalling, improving the efficiency of train marshalling.

In a specific implementation, as shown in FIG. 11, specific implementation steps corresponding to steps S501 to S503 are as follows:

S521: Obtain a train length corresponding to the target train and a region length corresponding to the first parking region.

S522: Obtain a second unmarshalling sequence and a second driving instruction corresponding to each target carriage if the region length is greater than the train length.

S523: Sequentially control, based on the second unmarshalling sequence, all the target carriages to execute the second driving instruction to drive from the marshalling dispatch parking line to the to-be-dispatched parking lines corresponding to the carriage types.

Step S521 is the same as step S501. To avoid repetition, the details are not repeated herein. Step S522 is a specific implementation of step S502, and step S523 is a specific implementation of step S503.

The second unmarshalling sequence refers to a sequence of unmarshalling dispatch among all the target carriages when the region length is not greater than the train length, which is a type of unmarshalling dispatch sequence. The second driving instruction refers to a driving control instruction corresponding to each target carriage when the region length is not greater than the train length. In this case, a target driving route in the first driving instruction is a driving route from the second parking region of the marshalling dispatch parking line to the to-be-dispatched parking lines. Since the region length is not greater than the train length, the train unmarshalling process cannot be carried out in the first parking region, but needs to be cooperatively carried out in the first parking region and the second parking region. In addition, in the process of driving from the second parking region to the to-be-dispatched parking lines, the target carriages need to run straight and reverse.

As shown in FIG. 11, since the target train includes the head carriage T1 and the tail carriage T2 at both ends, and the middle carriages B4/B3/B2/B1 are located between the head carriage T1 and the tail carriage T2, the second dispatch sequence formed in this solution is T1/B4/B3/B2/B1/T2/T1. That is, T1 is first controlled to run straight to the first parking region of C1 and parked, B4/B3/B2/B1 are then controlled to run straight from the second parking region of C1 and then reverse to enter C2, T2 is controlled to run straight from the second parking region of C1 and then reverse to enter C1, and finally, T1 is controlled to reverse and enter C1, to complete the train unmarshalling process. In this way, all the target carriages are parked according to the carriage types during the train unmarshalling process, to facilitate the subsequent train marshalling, improving the efficiency of train marshalling.

An embodiment of the present disclosure provides a train dispatching control method. The train dispatching control method is applied to the carriage control platform shown in FIG. 1. The carriage control platform is disposed inside the intelligent carriage and is configured to be communicatively connected to the system control platform. The carriage control platform may be communicatively connected to the system control platform to cooperate with the purpose of completing the train dispatching control according to different transportation capacity requirements.

As shown in FIG. 1, each intelligent carriage includes a carriage control platform, a driving control module connected to the carriage control platform for implementing automatic driving, an in-vehicle positioning and navigation module for implementing carriage positioning, and at least one obstacle detection module for implementing obstacle detection. It may be understood that, each intelligent carriage is equipped with a carriage control platform, a driving control module, an in-vehicle positioning and navigation module, and an obstacle detection module, so that each intelligent carriage can independently realize functions such as driving control, carriage positioning, and obstacle detection and positioning, so that each intelligent carriage can quickly deal with various situations encountered in the process of train marshalling or unmarshalling in real time.

The in-vehicle positioning and navigation module is a module configured to realize the train positioning function and the navigation function. In an example, a global navigation satellite system (GNSS)/an inertial measurement unit (IMU) combination may be configured to perform the positioning function or the navigation function. For example, in the example corresponding to steps S201 to S203, that is, in the process of train marshalling dispatch, the in-vehicle positioning and navigation module of each intelligent carriage sends acquired position data to the carriage control platform, so that the carriage control platform forms carriage positioning information based on the received position data; and sends the carriage positioning information to the system control platform, so that the system control platform determines a target carriage according to the obtained carriage positioning information.

The obstacle detection module is a module configured to realize the obstacle detection function. In an example, the obstacle detection module includes, but is not limited to, a camera sensing module, a millimeter-wave radar sensing module, a laser radar sensing module, and an ultrasonic sensing module mentioned in this embodiment. The camera sensing module is configured for recognition of obstacles, traffic lights, road directions, terrain, and markers. The millimeter-wave radar sensing module is configured for obstacle detection and is suitable for medium and long-distance obstacle detection. The laser radar sensing module is configured for obstacle detection and recognition, lane line recognition, auxiliary positioning, and map construction, to form a high-definition three-dimensional map. The ultrasonic sensing module is configured for obstacle detection, assists in maintaining distances between vehicles and surrounding environments, and is suitable for short-distance detection. In this embodiment, each intelligent carriage uses a plurality of obstacle detection modules to complement and cooperate with each other to form a comprehensive description of the surrounding environment, thereby making full use of the redundancy and complementarity of obstacle detection information acquired by the plurality of obstacle detection modules, which helps to obtain more accurate obstacle detection information.

The obstacle detection information is information detected by the obstacle detection module and used for reflecting whether there is an obstacle. The obstacle detection information further includes the presence of an obstacle and the absence of an obstacle. In an example, if the obstacle detection information is that there is an obstacle, it indicates that there is an obstacle in front of the intelligent carriage, and obstacle avoidance driving control needs to be performed to avoid the obstacle during driving, to achieve the purpose of safe driving. In another example, if the obstacle detection information is that there is no obstacle, it indicates that there is no obstacle in front of the intelligent carriage, so that no obstacle avoidance driving control is required, and the intelligent carriage may directly drive to a driving destination.

The carriage control platform is a module for implementing intelligent decision-making and intelligent control. In an example, the carriage control platform includes a central processing unit and a memory connected to the central processing unit. The memory stores a high-precision map for implementing carriage positioning processing, a positioning processing program for implementing positioning and navigating of position data, an obstacle detection program for implementing redundancy processing of obstacle detection information, and a driving control program for implementing intelligent decision-making. For example, after the carriage control platform receives the position data sent by the in-vehicle positioning and navigation module, the central processing unit executes the positioning processing program to process the position data and the high-precision map, so that the carriage positioning information can be quickly obtained, and the carriage positioning information is sent to the system control platform. In another example, after the carriage control platform receives obstacle detection information sent by the plurality of obstacle detection modules, the central processor executes the obstacle detection program to process the plurality of pieces of obstacle detection information to implement obstacle location. In another example, when the carriage control platform controls the driving of the intelligent carriage, the central processing unit may execute the driving control program, so that the driving control module can perform automatic driving.

The driving control module is a module configured to control the intelligent carriage to realize the driving function. In an example, the driving control module may control the intelligent carriage to implement driving functions such as driving control, braking control, and steering control, so that each intelligent carriage can independently complete the driving functions.

Figure 6:
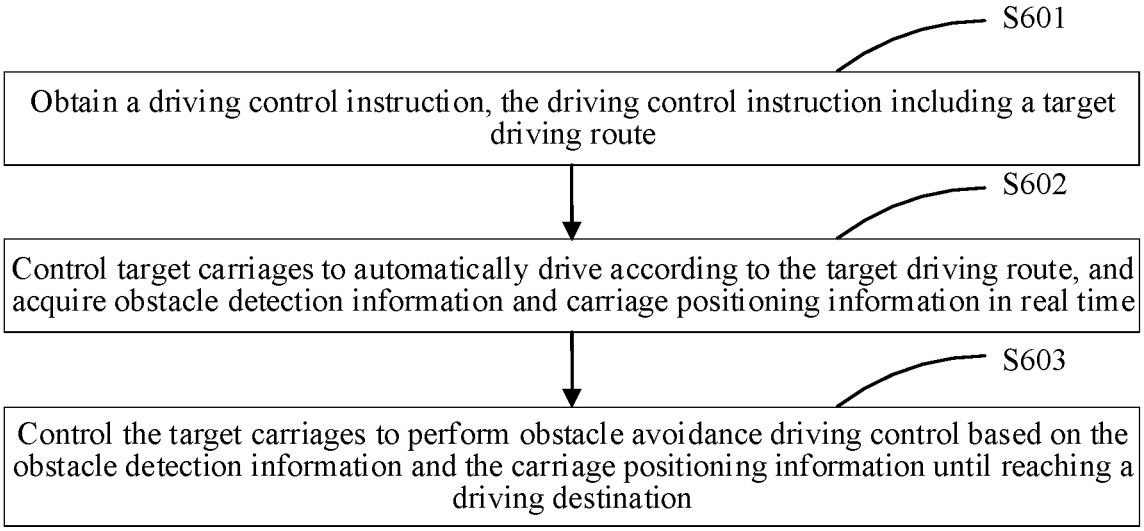
FIG. 6 is a flowchart of a train dispatching control method according to a fifth embodiment of the present disclosure.

In an embodiment of the present disclosure, a train dispatching control method is provided. According to the train dispatching control method, target carriages may be controlled to drive automatically, to complete a train dispatching process. The target carriages herein refer to intelligent carriages that need to be controlled during driving. In an example, the train dispatching control method may be applied to the carriage control platform of each target carriage, so that each carriage control platform can independently control the target carriage to drive, to complete the dispatching control of the target carriages. In another example, the train dispatching control method may be applied to the system control platform, so that the system control platform can dispatch a plurality of target carriages to run uniformly, to complete the dispatching control of the target carriages. As shown in FIG. 6, the train dispatching control method further includes the following steps:

S601: Obtain a driving control instruction, the driving control instruction including a target driving route.

The driving control instruction may be an instruction that is formed in the process of train marshalling or train unmarshalling and used for controlling the target carriages to drive. In an example, the driving control instruction may be an instruction that is automatically generated by the system control platform in the process of train marshalling or train unmarshalling, and is used for controlling the target carriages to automatically drive. It may be understood that, after generating the driving control instruction, the system control platform may send the driving control instruction to the carriage control platform, so that the carriage control platform controls the target carriages to automatically drive based on the received driving control instruction.

The target driving route is a driving route used for controlling the target carriages to automatically drive. In an example, in the train marshalling process, the target driving route is a driving route for driving the target carriages from the to-be-dispatched parking lines to the marshalling dispatch parking line. In another example, in the train unmarshalling process, the target driving route is a driving route for driving the target carriages from the marshalling dispatch parking line to the to-be-dispatched parking lines.

S602: Control target carriages to automatically drive according to the target driving route, and acquire obstacle detection information and carriage positioning information in real time.

Specifically, the carriage control platform may control, according to the received driving control instruction, a driving control module thereof to drive according to the target driving route, so that the target carriages automatically drive according to the target driving route, that is, an automatic driving technology is used, so that the target carriages can automatically drive between the to-be-dispatched parking lines and the marshalling dispatch parking line during the train marshalling or train unmarshalling, without manual driving of drivers, which helps to improve the driving efficiency and reduce labor costs.

In an example, the carriage control platform needs to receive obstacle detection information acquired by at least one obstacle detection module in real time in the process of controlling the target carriages to automatically drive along the target driving route. A preset redundancy processing algorithm may be configured to perform redundancy processing on all obtained obstacle detection information, to obtain the obstacle detection information after the redundancy processing, thereby ensuring the accuracy of the obtained obstacle detection information. The obstacle detection information after the redundancy processing is then configured to control the target carriages to implement intelligent obstacle avoidance in the process of automatic driving, to ensure the accuracy of obstacle avoidance driving control.

Specifically, in the process of controlling the target carriages to automatically drive along the target driving route, the carriage control platform needs to receive carriage positioning information acquired in real time by the in-vehicle positioning and navigation module, and detect in real time whether a driving destination of the target driving route is reached based on the carriage positioning information, or whether a parking line intersection is passed, or locate in time when obstacles appear.

S603: Control the target carriages to perform obstacle avoidance driving control based on the obstacle detection information and the carriage positioning information until reaching a driving destination.

Specifically, the carriage control platform controls the target carriages to perform obstacle avoidance driving control according to the obstacle detection information and the carriage positioning information received in real time. The obstacle avoidance driving control refers to control of avoiding obstacles during driving.

Specifically, an obstacle avoidance control program for implementing obstacle avoidance driving control may be set on the carriage control platform. When the obstacle detection information received by the carriage control platform is that there is an obstacle, the obstacle avoidance control program is executed, so that the carriage control platform avoids the obstacle when controlling the target carriages to drive, thereby ensuring the safety of the driving process. The obstacle avoidance control program is a preset computer program for implementing obstacle avoidance driving control.

In any example, when the obtained obstacle detection information is that there is an obstacle, a processor on the carriage control platform executes the obstacle avoidance control program, to form obstacle prompt information based on the obstacle detection information and the carriage positioning information. The obstacle prompt information is then sent to the system control platform, to prompt the staff of the system control platform to clear the obstacle in time at a position corresponding to the carriage positioning information according to the obstacle prompt information, thereby ensuring that the target carriage can drive smoothly to the driving destination. In this embodiment, the obstacle prompt information is information used for prompting the target carriage that there is an obstacle ahead.

In the train dispatching control method provided in the embodiments, the target carriages can automatically drive between the to-be-dispatched parking lines and the marshalling dispatch parking line according to the driving control instruction formed during the train marshalling or train unmarshalling, without manual driving of drivers, which helps to improve the driving efficiency and reduce labor costs, thereby improving the efficiency of train marshalling and train unmarshalling. Obstacle avoidance driving control is performed through obstacle detection information and carriage positioning information acquired in real time, to ensure that the target carriages can drive smoothly to a driving destination, so that the train marshalling or train unmarshalling process is automated, improving the dispatching efficiency during the train marshalling or train unmarshalling.

Figure 7:
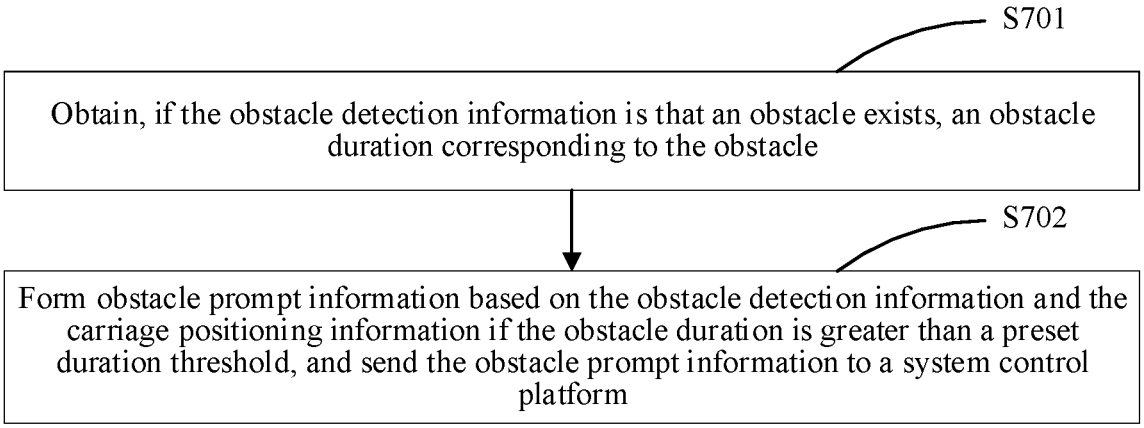
FIG. 7 is a flowchart of a train dispatching control method according to a sixth embodiment of the present disclosure.

In an embodiment of the present disclosure, as shown in FIG. 7, step S603, that is, controlling the target carriages to perform obstacle avoidance driving control based on the obstacle detection information and the carriage positioning information further includes the following steps:

S701: Obtain, if the obstacle detection information is that an obstacle exists, an obstacle duration corresponding to the obstacle.

S702: Form obstacle prompt information based on the obstacle detection information and the carriage positioning information if the obstacle duration is greater than a preset duration threshold, and send the obstacle prompt information to a system control platform.

The obstacle duration corresponding to the obstacle refers to a duration that a same obstacle is continuously sensed by at least one obstacle detection module of the target carriage. The preset duration threshold is a duration threshold preset for evaluating whether prompt information needs to be formed.

For example, the preset duration threshold is set to t0. It is assumed that an obstacle is sensed by at least one obstacle detection module at a moment t1, obstacle detection information is then formed and sent to the carriage control platform. The carriage control platform first controls the target carriage to stop running according to the received obstacle detection information that an obstacle exists. In obstacle detection information received again at a moment t2, if the obstacle detection information received again includes the same obstacle, the obstacle duration corresponding to the obstacle is t2−t1. After obtaining the obstacle duration t2−t1 corresponding to the obstacle, the obstacle duration t2−t1 needs to be compared with the preset duration threshold t0. If the obstacle duration t2−t1 is greater than the preset duration threshold t0, it is determined that the obstacle has existed for a long time, and is generally an inactive object. The obstacle prompt information needs to be sent to the system control platform, so that the system control platform clears the obstacle in time at a position corresponding to the carriage positioning information according to the obstacle prompt information, thereby ensuring that the target carriage can drive smoothly to the driving destination. If the obstacle duration t2−t1 is not greater than the preset duration threshold t0, it is determined that the obstacle exists for a short period of time, and is generally a moving object, which has left the front of the target carriage and does not affect the automatic driving of the target carriage. Therefore, there is no need to form obstacle prompt information, thereby reducing the workload of the system control platform and effectively reducing processing costs.

Figure 8:
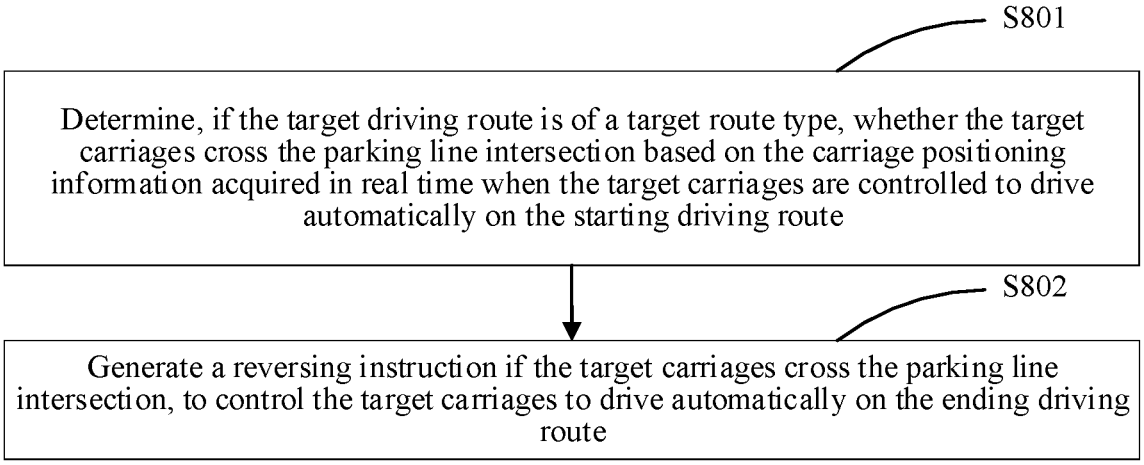
FIG. 8 is a flowchart of a train dispatching control method according to a seventh embodiment of the present disclosure.

In an embodiment of the present disclosure, the target driving route includes a starting driving route and an ending driving route, and the starting driving route and the ending driving route intersect at a parking line intersection. The starting driving route refers to a driving route in a same starting direction as a starting point of the driving. The ending driving route refers to a driving route in a same direction as an ending direction when driving to a driving destination. Correspondingly, as shown in FIG. 8, the controlling target carriages to automatically drive according to the target driving route in step S602 further includes the following steps:

S801: Determine, if the target driving route is of a target route type, whether the target carriages cross the parking line intersection based on the carriage positioning information acquired in real time when the target carriages are controlled to drive automatically on the starting driving route.

The target route type refers to a route type in which the starting driving route and the ending driving route are not the same driving route, and is specifically a route type corresponding to the target driving route formed in the train marshalling or unmarshalling process shown in FIG. 11. The target route type shown in this embodiment may be understood as a route type in which straight driving first and reversing are required, that is, a route type in which straight driving is first performed on the starting driving route and reversing is performed on the ending driving route.

Since the target route type is a route type in which straight driving first and reversing are required, a position at which the target carriage starts to reverse needs to be determined in this case. In the example corresponding to FIG. 11, in the process of train marshalling or unmarshalling, straight driving first and reversing are required, and the reversing is performed after the target carriage runs straight until the tail of the carriage exceeds the parking line intersection on the marshalling dispatch parking line. Therefore, the carriage control platform may determine whether the target carriage crosses the parking line intersection based on the carriage positioning information acquired in real time when controlling the target carriage to drive automatically on the starting driving route, to determine whether a reversing position is reached.

S802: Generate a reversing instruction if the target carriages cross the parking line intersection, to control the target carriages to drive automatically on the ending driving route.

Specifically, when detecting that the tail of the target carriage crosses the parking line intersection, the carriage control platform generates a reversing instruction, to control the target carriage to execute the reversing instruction and automatically drive along the driving destination on the ending driving route, to complete the automatic driving operation on the target driving route.

If the target driving route is not of the target route type, it indicates that the starting driving route and the ending driving route are the same driving route, the carriage control platform then controls the target carriage only to automatically drive on the target driving route in the same driving direction with only a straight driving operation and without a reversing operation, to complete the automatic driving operation on the target driving route.

In the train dispatching control method provided in this embodiment, the carriage positioning information is configured to determine whether the parking line intersection is crossed, so that the automatic driving of the target carriage that needs to be reversed can be controlled, thereby ensuring the realization of the automatic driving function.

It is to be understood that the order of the sequence numbers of the steps in the foregoing embodiments does not mean the order of execution, and the execution order of each process is determined by its function and inherent logic, and does not constitute any limitation on the implementation process of the embodiments of the present disclosure.

In an embodiment, a system control platform is provided, including: a memory, a processor, and a computer program stored in the memory and capable of being run on the processor, where the processor implements the steps of the train dispatching control method in the foregoing embodiments when executing the computer program, for example, the steps S201 to S203 shown in FIG. 2 or the steps shown in FIG. 3 to FIG. 5. The details are not repeated herein to avoid repetition.

In an embodiment, a carriage control platform is provided, including: a memory, a processor, and a computer program stored in the memory and capable of being run on the processor, where the processor implements the steps of the train dispatching control method in the foregoing embodiments when executing the computer program, for example, the steps S601 to S603 shown in FIG. 6 or the steps shown in FIG. 7. The details are not repeated herein to avoid repetition.

In an embodiment of the present disclosure, an intelligent carriage is provided, including the foregoing carriage control platform, a driving control module connected to the carriage control platform for implementing automatic driving, an in-vehicle positioning and navigation module for implementing carriage positioning, and at least one obstacle detection module for implementing obstacle detection.

In an embodiment of the present disclosure, a train dispatching control system is provided, including the foregoing system control platform and at least one of the foregoing intelligent carriages connected to the system control platform, the system control platform communicating with a carriage control platform assembled on each intelligent carriage through a network.

In an embodiment of the present disclosure, a computer-readable storage medium is provided, storing a computer program, the computer program, when executed by a processor, implementing the steps of the train dispatching control method in the foregoing embodiments, for example, the steps S201 to S203 shown in FIG. 2 or the steps shown in FIG. 3 to FIG. 8. The details are not repeated herein to avoid repetition.

A person of ordinary skill in the art may understand that some or all procedures in the foregoing method embodiments may be implemented by a computer program instructing related hardware. The computer program may be stored in a non-volatile computer-readable storage medium, and when the computer program is executed, the procedures of the foregoing method embodiments may be performed. Any reference to a memory, a storage, a database, or another medium used in the embodiments provided in this application can include a non-volatile and/or volatile memory. The non-volatile memory may include a read-only memory (ROM), a programmable ROM (PROM), an electrically programmable ROM (EPROM), an electrically erasable programmable ROM (EEPROM) or a flash memory. The volatile memory may include a random access memory (RAM) or an external high-speed cache. By way of description rather than limitation, the RAM may be obtained in a plurality of forms, such as a static RAM (SRAM), a dynamic RAM (DRAM), a synchronous DRAM (SDRAM), a double data rate SDRAM (DDRSDRAM), an enhanced SDRAM (ESDRAM), a synchlink (Synchlink) DRAM (SLDRAM), a rambus (Rambus) direct RAM (RDRAM), a direct rambus dynamic RAM (DRDRAM), and a rambus dynamic RAM (RDRAM).

A person skilled in the art may clearly understand that, for the purpose of convenient and brief description, only division of the foregoing function units is used as an example for description. In the practical application, the functions may be allocated to and completed by different functional modules according to requirements. That is, an internal structure of the device is divided into different functional units or modules, to complete all or some of the functions described above.

The foregoing embodiments are merely used for describing the technical solutions of the present disclosure, but are not intended to limit the present disclosure. Although the present disclosure is described in detail with reference to the foregoing embodiments, It should be understood by a person of ordinary skill in the art that modifications can be made to the technical solutions described in the foregoing embodiments, or equivalent replacements can be made to some technical features in the technical solutions, as long as such modifications or replacements do not cause the essence of corresponding technical solutions to depart from the spirit and scope of the technical solutions of the embodiments of the present disclosure, which shall fall within the protection scope of the present disclosure.

What is claimed is:

1. A train dispatching control method, comprising:

obtaining a train marshalling instruction, the train marshalling instruction comprising a marshalling quantity;

determining target carriages corresponding to the marshalling quantity based on carriage positioning information corresponding to to-be-dispatched carriages parked on to-be-dispatched parking lines; and controlling the target carriages to drive from the to-be-dispatched parking lines to a marshalling dispatch parking line, to form a target train, wherein the to-be-dispatched carriages comprise at least one head carriage, at least one tail carriage, and at least one middle carriage, and the to-be-dispatched parking lines comprise a first parking line for parking the head carriage and the tail carriage and a second parking line for parking the middle carriage, one head carriage and one tail carriage being a group; and the determining target carriages corresponding to the marshalling quantity based on carriage positioning information corresponding to to-be-dispatched carriages parked on the to-be-dispatched parking lines comprises:

determining an outermost group of head carriage and tail carriage on the first parking line based on the carriage positioning information corresponding to the to-be-dispatched carriages parked on the to-be-dispatched parking lines; and determining N-2 outermost middle carriages on the second parking line based on the carriage positioning information corresponding to the to-be-dispatched carriages parked on the to-be-dispatched parking lines, N being the marshalling quantity, and the target carriages comprising the outermost group of head carriage and tail carriage on the first parking line and the N-2 outermost middle carriages on the second parking line.

2. A train dispatching control method, comprising:

obtaining a train marshalling instruction, the train marshalling instruction comprising a marshalling quantity;

determining target carriages corresponding to the marshalling quantity based on carriage positioning information corresponding to to-be-dispatched carriages parked on to-be-dispatched parking lines; and controlling the target carriages to drive from the to-be-dispatched parking lines to a marshalling dispatch parking line, to form a target train, wherein the marshalling dispatch parking line and the to-be-dispatched parking lines intersect at a parking line intersection, and the marshalling dispatch parking line comprises a first parking region and a second parking region formed based on the parking line intersection; and the controlling the target carriages to drive from the to-be-dispatched parking lines to a marshalling dispatch parking line, to form a target train comprises:

obtaining a train length corresponding to the target carriages and a region length corresponding to the first parking region;

obtaining, based on a comparison result of the train length and the region length, a marshalling dispatch sequence and a driving control instruction corresponding to the comparison result; and sequentially controlling, based on the marshalling dispatch sequence, the target carriages to execute the driving control instruction to drive from the to-be-dispatched parking lines to the marshalling dispatch parking line, to form the target train.

3. The train dispatching control method according to claim 2, wherein the driving control instruction comprises a target driving route, and the sequentially controlling the target carriages to execute the driving control instruction comprises:

sending the driving control instruction to carriage control platforms assembled on the target carriages, so that the carriage control platforms control the target carriages to drive according to the target driving route, acquire obstacle detection information and carriage positioning information in real time, and control the target carriages to perform obstacle avoidance driving control based on the obstacle detection information and the carriage positioning information until a driving destination is reached.

4. The train dispatching control method according to claim 3, wherein the controlling the target carriages to perform obstacle avoidance driving control based on the obstacle detection information and the carriage positioning information comprises:

obtaining, if the obstacle detection information is that an obstacle exists, an obstacle duration corresponding to the obstacle; and forming obstacle prompt information based on the obstacle detection information and the carriage positioning information if the obstacle duration is greater than a preset duration threshold, and sending the obstacle prompt information to a system control platform.

5. The train dispatching control method according to claim 3, wherein the target driving route comprises a starting driving route and an ending driving route, and the starting driving route and the ending driving route intersect at the parking line intersection; and the controlling the target carriages to drive automatically according to the target driving route comprises:

determining, if the target driving route is of a target route type, whether the target carriages cross the parking line intersection based on the carriage positioning information acquired in real time when the target carriages are controlled to drive automatically on the starting driving route; and generating a reversing instruction if the target carriages cross the parking line intersection, to control the target carriages to drive automatically on the ending driving route.

6. A system control platform, comprising a memory, a processor, and a computer program stored in the memory and executable on the processor, the processor, when executing the computer program, performing a train dispatching control method to:

obtain a train marshalling instruction, the train marshalling instruction comprising a marshalling quantity;

determine target carriages corresponding to the marshalling quantity based on carriage positioning information corresponding to to-be-dispatched carriages parked on to-be-dispatched parking lines; and control the target carriages to drive from the to-be-dispatched parking lines to a marshalling dispatch parking line, to form a target train, wherein the to-be-dispatched carriages comprise at least one head carriage, at least one tail carriage, and at least one middle carriage, and the to-be-dispatched parking lines comprise a first parking line for parking the head carriage and the tail carriage and a second parking line for parking the middle carriage, one head carriage and one tail carriage being a group; and to determine target carriages corresponding to the marshalling quantity based on carriage positioning information corresponding to to-be-dispatched carriages parked on the to-be-dispatched parking lines, the processor performs:

determining an outermost group of head carriage and tail carriage on the first parking line based on the carriage positioning information corresponding to the to-be-dispatched carriages parked on the to-be-dispatched parking lines; and determining N-2 outermost middle carriages on the second parking line based on the carriage positioning information corresponding to the to-be-dispatched carriages parked on the to-be-dispatched parking lines, N being the marshalling quantity, and the target carriages comprising the outermost group of head carriage and tail carriage on the first parking line and the N-2 outermost middle carriages on the second parking line.

7. The system control platform according to claim 6, wherein the system control platform is connected to at least one intelligent carriage of a train dispatching control system, and the system control platform communicates with a carriage control platform assembled on each of the at least one intelligent carriage through a network.

* * * * *